United States Patent [19]

Riley et al.

[11] 4,195,892

[45] Apr. 1, 1980

[54] BATCH PRODUCTION OF PLASMA DISPLAY PANELS

[75] Inventors: Timothy J. Riley, Lake Hill; Nicholas Vecchiarelli, Marlboro; Richard A. Fritz, Red Hook, all of N.Y.

[73] Assignee: International Business Machines Corporation, Armonk, N.Y.

[21] Appl. No.: 911,592

[22] Filed: Jun. 1, 1978

[51] Int. Cl.[2] ..... H01J 9/385; H01J 9/395

[52] U.S. Cl. ..... 316/20; 29/413

[58] Field of Search ..... 316/19, 20; 29/413

[56] References Cited

U.S. PATENT DOCUMENTS

| | | | |
|---|---|---|---|
| 3,461,537 | 8/1969 | Lotz | 29/413 |
| 3,837,724 | 9/1974 | Haberland et al. | 316/20 |
| 3,944,868 | 3/1976 | Kupsky | 313/517 |
| 3,959,683 | 5/1976 | Kupsky | 313/218 |
| 4,029,371 | 6/1977 | Kupsky | 316/19 |
| 4,083,614 | 4/1978 | Aboelfotoh et al. | 316/20 |

*Primary Examiner*—John McQuade
*Attorney, Agent, or Firm*—Joseph J. Connerton

[57] ABSTRACT

A batch fabrication process to produce plasma display panels uses a multiple processing technique in which a series of individual plate patterns are simultaneously developed on a large master plate. When the master plate processing is completed and inspected, individual plates with associated tubulation members are provided and placed over the individual non-defective plate patterns on the master plate and sealed. The master plate is then divided into individual plates by conventional glass separation techniques such as cutting, scribing, etc. and the individual panels thus formed are completed by bakeout, backfill with an ionizable gas and tubulation tip-off. This permits plasma display panel fabrication in a batch mode using conventional fabrication techniques, permitting multiple plasma panel fabrications in a single process cycle.

10 Claims, 2 Drawing Figures

BATCH PRODUCTION OF PLASMA DISPLAY PANELS

CROSS REFERENCE TO RELATED APPLICATIONS

U.S. Application Ser. No. 405,205 for "Gas Panel Fabrication" filed by Peter H. Haberland et al Sept. 24, 1974, now U.S. Pat. No. 3,837,724.

U.S. Application Ser. No. 736,802 for "Method of Manufacturing Gas Panel Assembly" filed by M. Osama Aboelfotoh et al Oct. 29, 1976 now U.S. Pat. No. 4,083,614.

U.S. Application Ser. No. 892,703 , for "A C Scan Panel" filed by William R. Lamoureux et al Apr. 3, 1978.

BACKGROUND OF THE INVENTION

In the fabrication of plasma panel assemblies such as disclosed in the aforereferenced Haberland et al U.S. Pat. No. 3,837,724, metallic conductor arrays comprising display electrodes are formed on the surface of glass plates or substrates and a layer of insulating glass dielectric frit or slurry formed over the surface of the conductors to provide a smooth film of substantially uniform thickness across the entire surface. An overcoat layer of a refractory secondary emissive material such as magnesium oxide to prevent sputtering and permit lower operating voltages is evaporated over the dielectric layer. When the individual plates are thus formed, a tubulation member and associated seal is inserted in the upper glass member, and the plates are edge sealed to form a chamber, which in turn is controlled through spacer technology to provide a uniform gap across the entire display area of the panel. Conventionally, the panel is then baked in vacuum to eliminate impurities and residual gases including water vapor from the surface of the dielectric. Following bake-out, the panel is backfilled with an ionizable gas capable of emitting light in response to drive signals selectively applied to pairs of orthogonally disposed conductors. Upon completion of panel fabrication, the electrical parameters are stabilized by a burn-in-cycle, and the static and dynamic margins of the panel tested. Such a process on an individual panel basis is complex and time consuming, involving relatively lengthy furnace cyles such that means to increase the efficiency of the fabrication process and thereby reduce the cost are desirable.

SUMMARY OF THE INVENTION

In accordance with the present invention, a modular method of fabricating gas panels is described in which a number of plates are simultaneously formed on a single substrate. Both the back and front plates may be tested and inspected using existing techniques to identify defective plates, which may then be either repaired or discarded. The master plates containing in the perferred embodiment the vestical conductor array and herein designated the bottom plate will remain in the form of a large substrate, while the horizontal pattern plates, herein designated the top plates, will be individually separated by conventional glass cutting techniques and any defective plates discarded. Defective plate patterns in the master plate will not be utilized. Individual top plates are then selectively assembled on the master plate, except for those individual plates which are defective, and a plurality of gas panels are simultaneously formed using this technique. Following the sealing cycle, the plates thus formed are separated or cut into individual panels which then complete processing and undergo final testing. By means of this approach, a number of panels, eight in the described embodiment, can be simultaneously fabricated using the same techniques and time required in the prior art to fabricate individual panels, so that a substantial saving in time and cost is thereby afforded.

Accordingly, a primary object of the present invention is to provide a multiple panel assembly process.

Another object of the present invention is to provide an improved multiple panel assembly process in which individual plates for a plurality of panels are simulatenously formed on a master plate and mated with corresponding individual plates to simultaneously form a plurality of panels.

Another object of the invention is to provide an improved method for multiple plasma display assemblies in which a plurality of panels are assembled on a single master plate and thereafter separated into individual plasma assemblies.

The foregoing and other objects, features and advantages of the invention will be apparent from the following more particular Description of the Preferred Embodiment as illustrated in the accompanying drawings.

DESCRIPTION OF THE PREFERRED EMBODIMENT

Figure 1:
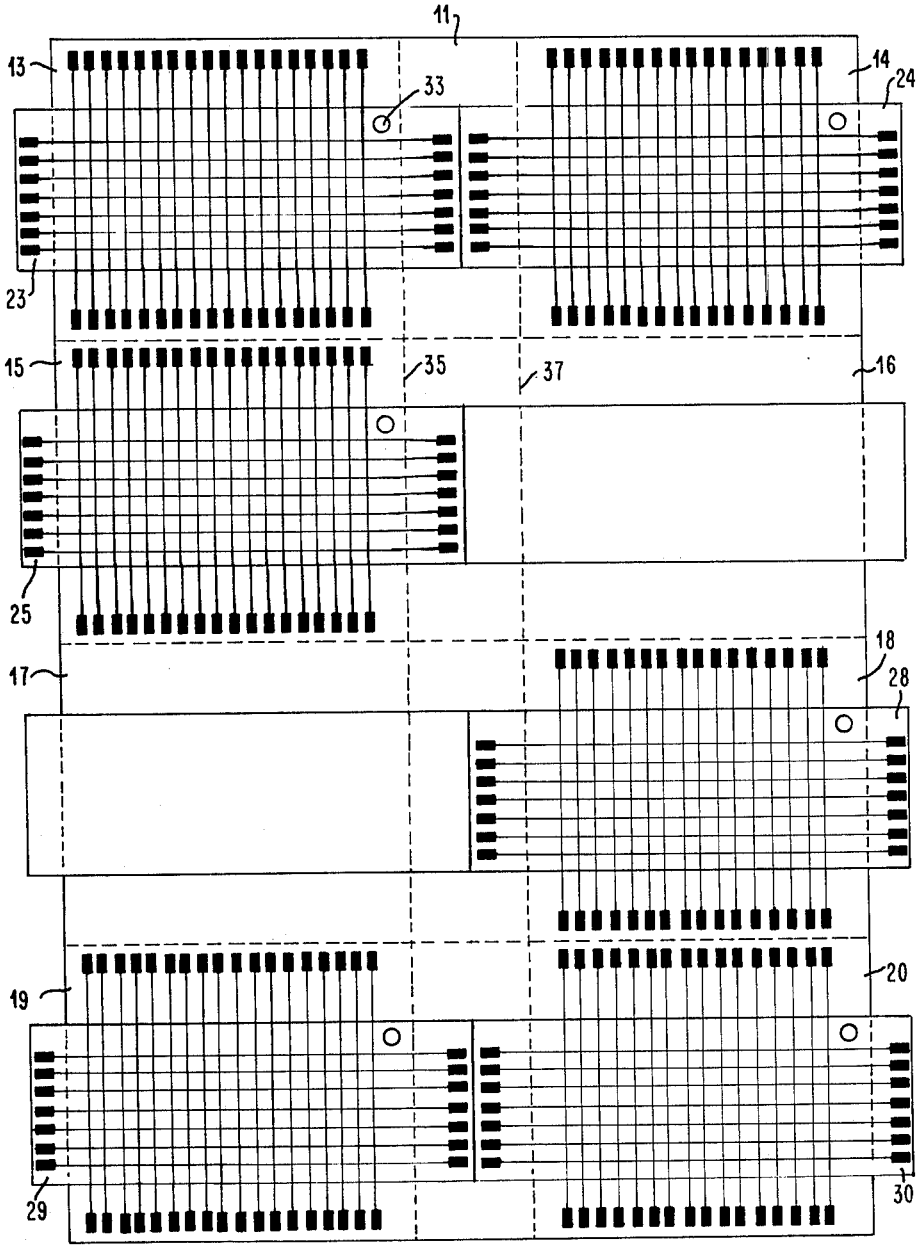
FIG. 1 illustrates a topview of the master plate which is combined with individual plates to provide multiple panel assemblies.

Referring now to the drawings and more particularly to FIG. 1 thereof, a rectangular glass substrate or master plate 11 has a number of individual panel patterns arranged on individual plates 13 through 20. Before continuing the description of the preferred embodiment, some background information on gas panel assemblies should be noted. Typical gas panel assemblies consist of a pair of glass substrates on which orthogonal conductor arrays have been formed, the intersections of respective conductors defining display sites or cells. The conductor arrays in turn are overcoated with glass dielectric which function to provide a wall charge memory capability to the assemblies. Selection of individual cells is provided by applying signals of write amplitude across pairs of selected orthogonal conductors whereby the gas between the selected conductors is ionized to emit light. Conventionally, the conductors are disposed in horizontal and vertical arrays on opposing plates, and generally driven from terminal or load on the conductor extremities, which in turn are connected to the driving selection circuitry through conventional interconnection techniques.

Referring back to FIG. 1, the individual conductor arrays on the master plate 11 in the preferred embodiment form the vertical conductor array, although it will be appreciated that either horizontal or vertical arrays could be so utilized on the master plate. The panel patterns on individual plate areas 13 through 20 will be formed in accordance with the identical process described in the aforenoted Haberland et al U.S. Pat. No. 3,837,724. The master plate 11 is washed and metallized using conductor metallurgy of chrome-copper-chrome applied in layers by consecutive depositions, the intermediate copper layer comprising the conductor, the chrome layers providing adhesion to the glass and protection of the copper layer against attack by the reactive glass during the dielectric reflow process. Deposition of the metallic thin films is preferably provided by conventional vacuum metallization techniques.

After the metallic layers have been applied to master plate 1, a photolithic process converts the laminate into a plurality of parallel lines which serve as the vertical conductors. The laminate terminates a given distance from the edges of the master plate for reasons explained later. A liquid photoresist material is then applied by roller or other conventional means over the outer chrome layer and baked dry. The photoresist is then exposed to a light pattern of artwork having the desired configuration of a plurality of individual panel assembly plates. After the exposure of the photoresist material is completed, the master plate is then immersed in a developer solution until the exposed resist material is removed, while the unexposed areas of the photoresist remain undisturbed. The master plate is next cleaned and then immersed in a second solution which etches away the chromium-copper-chromium laminate from regions not protected by the resist material. This etching process leaves a plurality of individual parallel conductor arrays, vertical in the preferred embodiment, formed on individual patterns on the master plate, with each conductor being composed of a chrome-copper-chrome laminate having an outer coating of unexposed resist. This resist is then exposed and placed in a developer until it is removed, and the resulting parallel lines terminated at a specified distance from the edges of the master plate. For additional details concerning the conductor formation and photolithographic process, reference is made to the Haberland et al U.S. Pat. No. 3,837,724. A similar batch fabrication technique can be used to develop the top plates having the horizontal conductor array thereon, such as plates 23–25 and 28–30 shown in FIG. 1.

The final step on the plates prior to assembly is to overcoat with a dielectric layer and a refractory coating of secondary emissive material, as heretofore described. For details concerning the dielectric, reference is again made to U.S. Pat. No. 3,837,724. When the top or front plates are formed in a batch mode, they are immediately scribed or scored and cut by conventional glass breaking techniques into individual plate assemblies which are individually mated to the plate patterns on the master assembly after individual testing. Thus only those individual plates 13 through 20 which are free from defects are utilized in final assembly. This technique is preferred to a batch processing utilizing two master plates which are formed and cut in the prescribed manner, since no provision would be available for defective plates. Each of the horizontal top plates has a circular opening such as opening 33 of plate 23. A hollow glass tube or tubulation member is inserted in this opening in each upper plate, and sealing material which may be a preform washer or ring of sealant glass is placed around the tube, and the master plate and individual plate assemblies placed in an oven and fired until the glass sealing material reflows, sealing the plates and tubulation member in position. Conventional spacer techniques such as the hard glass spacing rods of the Haberland et al patent will be utilized to maintain a uniform discharge gap between the plates of the individual assemblies. Likewise, conventional plasma panel sealing techniques can be employed to seal the edges of the individual top plate assembly to the corresponding plate of the master assembly. In the illustrated embodiment of FIG. 1, it is assumed for purposes of description that assemblies 16, 17 of master plate 11 are defective, and the associated vertical conductors are not shown to emphasize this condition. In practice, however, a vertical conductor array would exist on plate areas 16, 17 of master plate 11 although they would not be utilized.

Assuming the horizontal plates 23–25 and 28–30 were also simultaneously formed, following the sealing cycle in which the perimeters of the plates are sealed to provide a gaseous envelope, the individual panels are then scored or scribed and separated. A pair of scribe lines 35, 37 in the vertical direction are positioned toward the center of the master plate 11. As shown, only the bottom portion of the plate is snapped to permit cabling or other connector technology to be applied to the horizontal drive lines from either direction. In the preferred embodiment, seven horizontal lines are illustrated by way of example to symbolize a single line display using a $5\times7$ dot matrix, although within reasonable limits, any size display and format could be utilized. However, it is apparent that the efficiency of the invention will vary directly as the maximum number of panels which can be accomodated, and this in turn varies inversely as the size of the individual panels. Any of the individual bottom plates 13 through 20 which are defective, plates 16 and 17 in FIG. 1, will be discarded upon separation.

The individual panels after bakeout are then backfilled with the ionizable gas at the specified pressure, and the tubulation members sealed or tipped off to contain the gas. Details of the bakeout and backfill operation including the specific gas composition and pressure are described in the referenced Haberland et al U.S. Pat. No. 3,837,724. Once assembled in this manner, the panels will be tested and subsequently handled in the same manner as individual assemblies.

The above described multiple assembly and separation process provides panel assemblies which are yield oriented by the capability of discarding defective plates at the appropriate operation, designed to provide panels having the necessary 2 to 4 termination sites (aprons) outside the panel seals and improve control of the chamber gap within the individual panels assemblies compared to the assembly, seal and cutting the two master panels.

Figure 2:
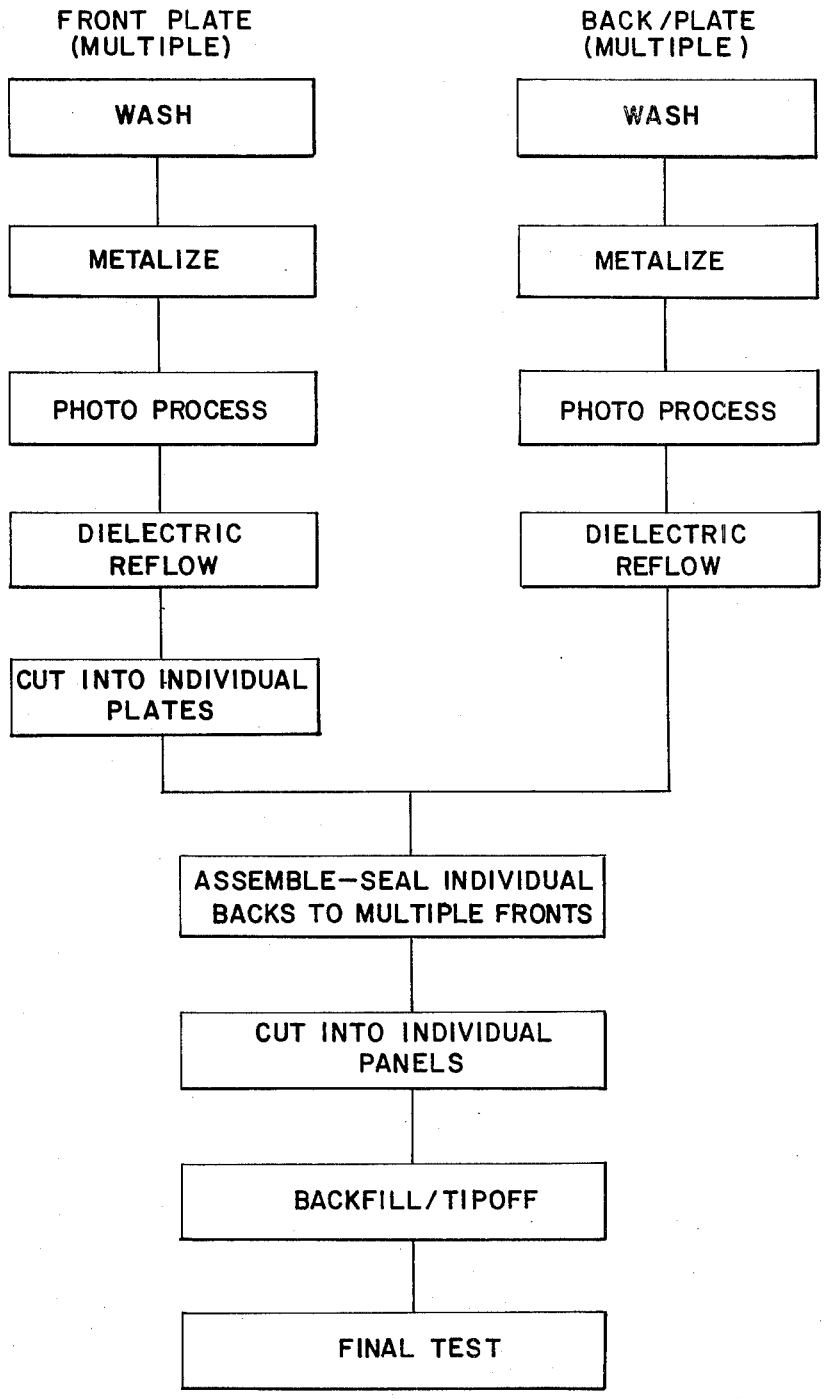
FIG. 2 is a flow diagram of the individual steps involved in a batch plasma display fabrication.

Referring now to FIG. 2, the operating sequence of the present invention is illustrated in the form of a flow chart or sequence of operations. The same terms as previously designated relative to top and bottom plates are again employed, the bottom plate being the master or mother plate and the top plates comprising the individual panel plates which may be fabricated in the same manner but are cut into individual plates prior to panel fabrication. Both top and bottom plates, which may represent conventional soda lime silica glass, are washed and then metallized as previously described. The individual patterns are then formulated using the photolithographic process to convert the individual metallized laminates in the particular conductor pattern defined by the associated masks. Following the etching process, the chrome-copper-chrome conductors are overcoated with a dielectric layer which is applied in the form of a lead glass frit by any conventional process such as spraying and then reflowed in the oven to produce the dielectric lead glass coating. While not shown in the flow diagram and not necessary to the operation of the instant invention, a layer of refractory material having a high characteristic of secondary emission such as magnesium oxide may be applied over the dielectric to prevent sputtering and permit operation at low operating voltage. At this stage, the front plate assembly is then cut into individual plates for individual panel assembly on the master plate.

After both the horizontal and vertical patterns have been inspected, the top plates are individually positioned with respect to the associated bottom plates until each of the bottom plates, other than defective plates, will have an associated top plate. A sealing material, which may comprise a powdered glass disposed in a cellulous binder or other form of glass solder or sealant material in the form of sealant rods, are then placed around the periphery of the individual panel assemblies. Tubulation is added to the upper plate of each of the panels and a glass sealing material which may be in the form of a ring of sealant is placed over the tubulation member. The entire assembly is then placed in an oven on a flat surface which might comprise for example, a polished lava plate which has been leveled with a machinist's level. The nitrocellulose binder, if employed, is baked out of the sealant material to avoid bursting and darkening of the sealant, as well as remove possible contaminants which subsequently might invade the illuminable gas. After cooling, the master plate is then cut into individual panel assemblies as described.

A vacuum pump is then connected to the tubulation of each panel to evacuate the panel and thereby eliminate any moisture or gas which might have escaped during the sealing and/or dielectric coating process. This ensures that the illuminable gas subsequently inserted will remain free of contamination from the sealing material and dielectric coating, the latter of which forms the chamber walls for the plasma panel. Following the evacuation process, the vacuum pump is removed from the tube and an illuminable gas is then admitted to the chamber and backfilling with the illuminable gas continues until a pressure of 200 to 700 TORR is reached. The illuminable gas is passed slowly to the chamber and when it reaches the prescribed pressure, the tubulation is then tipped to seal the chamber with the illuminable gas at a given pressure. A check on the gas in the chamber may be made with the use of a spectrometer. Following this, the panel is then subject to the conventional electric test of the type described in the aforereferenced Haberland U.S. Pat. No. 3,837,724 and designated as the final test.

It is apparent that the above described operation provides a significant fabrication cost utilizing conventional technology, and is particularly desirable for low size small character content panels of the type shown in the preferred embodiment. It should be noted that eight panels were shown in the preferred embodiment only by way of example, and that the invention is not technically limited to any specific size. Thus a novel fabrication technique is provided according to this invention for producing plasma display panels having uniformity in the mechanical, electrical and optical characteristics which permits batch fabrication. It also improves the control of the chamber gap within the individual panel assemblies as compared with the assembly seal and cutting of two large plates in the individual smaller plates.

While the method of this invention has been particularly shown and described with reference to a preferred embodiment thereof, it will be understood by those skilled in the art that various changes in form and detail might be made therein without departing from the spirit and scope of the invention.

Having thus described our invention, what we claim as new, and desire to secure by Letters Patent is:

1. A process for the batch fabrication of plasma display panels, said process including the steps of:

preparing a master plate having a size encompassing the areas of a plurality of panel plates, forming a conductor array on each of said panel plate areas, overcoating each of said conductor arrays with a dielectric layer, preparing a second plurality of individual panel plates with conductor arrays substantially orthogonal to those on said panel plate areas, positioning said individual panel plates on nondefective ones of said panel plate areas to form a plurality of panel assemblies mounted on a common master plate, sealing said panel assemblies simultaneously including maintaining a uniform discharge gap in each of said panel assemblies, cutting said master plate into a plurality of individual panels adapted for interconnection to a drive signal source, and backfilling each of said panels with an ionizable gas at a predetermined pressure.

2. A process of the type claimed in claim 1 wherein said forming of said conductor array comprises depositing a multi-layer laminate on the surface of each of said panel glass areas.

3. A process of the type claimed in claim 2 wherein said laminate is selectively etched to provide the line pattern for said conductor array.

4. A process of the type claimed in claim 3 wherein said etching is provided by photoetching techniques.

5. A process of the type claimed in claim 1 including the step of inspecting individual plates for defects prior to the positioning step.

6. A process of the type claimed in claim 5 including the additional step of applying a layer of refractory material having a high secondary emission ratio over said dielectric layer.

7. A process of the type claimed in claim 1 wherein said cutting step comprises snapping said panel assemblies whereby edge terminals are exposed for connection to said drive signal source.

8. A method of simultaneously fabricating a plurality of plasma panel assemblies during individual plate process cycles comprising the steps of preparing a master plate having dimensions adapted to encompass a plurality of plasma panel plates, forming a plurality of line patterns on said master plate, each of said line patterns corresponding to one plate of one of said plasma panel assemblies, said line pattern forming step comprising depositing conductor line patterns on each of said panel plates, each of said lines being a laminate composed of layers of chrome-copper-chrome, photoetching said laminate to complete said line pattern deposition, applying a dielectric glass frit over said individual line patterns on said master plate, firing said master plate on a level surface in an oven to reflow said glass frit into a protective glass coating covering said conductor patterns, placing on each of said line patterns in said master plate a glass sealant material and spacer means to maintain a uniform discharge gap on each of said panel assemblies, preparing a plurality of individual plasma panel plates having conductor arrays substantially orthogonal to the line patterns on said master plate, placing said individual plasma panel plates on the panel plates of said master plate, mounting tubulation members and associated glass sealants on said individual plasma panel plates, heating said master plate in an oven to seal the plates together spaced a predetermined distance controlled by said spacer means and seal said tubulation member in position, cutting said master plate into a plurality of individual panel assemblies with edges exposed for connection to a driving selection mechanism, and evacuating and backfilling each of said panel assemblies with an ionizable gas at a controlled pressure.

9. A method of the type claimed in claim 8 wherein said cutting step comprises scoring and snapping said master plate whereby edge terminals of said individual panel assemblies are exposed for coupling to said driving selection mechanism.

10. A method of the type claimed in claim 8 including the additional step of providing an overlayer of refractory material with high secondary emission characteristics over said reflowed dielectric glass frit to protect said panel assemblies against sputtering and lower the required operating signal levels.

* * * * *